US006940377B1

(12) United States Patent
Martin

(10) Patent No.: US 6,940,377 B1
(45) Date of Patent: Sep. 6, 2005

(54) MULTI-SHEET ARTICLE HAVING REMOVABLE PORTIONS COMPRISING MAGNETIZED MATERIAL

(75) Inventor: Robert Martin, Washington, MO (US)

(73) Assignee: Magnet LLC, Washington, MO (US)

( * ) Notice: Subject to any disclaimer, the term of this patent is extended or adjusted under 35 U.S.C. 154(b) by 0 days.

(21) Appl. No.: 11/018,991

(22) Filed: Dec. 21, 2004

(51) Int. Cl.[7] ..... B42D 1/00; H01F 7/20

(52) U.S. Cl. ..... 335/285; 281/38; 281/DIG. 1; 283/56

(58) Field of Search ..... 281/38, 51, DIG. 1; 283/51, 56; 402/503; 335/285

(56) References Cited

U.S. PATENT DOCUMENTS 5,380,043 A 1/1995 Schwartz
5,458,282 A 10/1995 Martin
5,575,503 A 11/1996 Takahashi
6,273,660 B1 8/2001 Ozgen et al.
2004/0012191 A1 1/2004 Stark

*Primary Examiner*—Ramon M. Barrera
(74) *Attorney, Agent, or Firm*—Thompson Coburn LLP

(57) ABSTRACT

A multi-sheet article comprising a plurality of sheets is disclosed. Each of the sheets has opposite first and second faces that share a common perimeter edge. Each sheet also has an edge margin that extends from a portion of the perimeter edge of the respective sheet. The edge margins of the sheets are bound to each other in a manner connecting the sheets to each other. At least a first one of the sheets comprises a first removable portion and at least one frangible connection that is configured and adapted to facilitate the separation of the first removable portion from the remainder of the first sheet and from the other sheets. This first removable portion comprises a portion of magnetized material. However, the edge margin of the first sheet of the multi-sheet article is devoid of magnetized material.

20 Claims, 5 Drawing Sheets

MULTI-SHEET ARTICLE HAVING REMOVABLE PORTIONS COMPRISING MAGNETIZED MATERIAL

BACKGROUND OF THE INVENTION (1) Field of the Invention

This invention pertains to the field of magnetized advertisements, coupons, and the like. More particularly, this invention pertains to a multi-page article that comprises at least one sheet that has removable portions with magnetized material. The removable portions of the sheet may bare advertisements and can be magnetically attached to metallic surfaces.

(2) General Information

Various multi-sheet articles, such as phonebooks, often comprise advertisements for various goods and services. Additionally, discount coupons and the like, are also frequently included in multi-sheet articles. It is often desirous for people using such advertisements and coupons to remove them from the multi-sheet article. For example, it may be desirous to remove an advertisement from a multi-sheet article to simplify future reference. Additionally, it may be necessary to remove a coupon from a multi-sheet article to redeem the benefits associated with the coupon.

To facilitate the removal of advertisements and coupons from multi-sheet articles, frangible connections such as perforations or score lines are often utilized. By forming frangible connections around the periphery of a portion of a sheet, the portion of the sheet can be easily removed by hand, without resort to using scissors or the like. Additionally, the use of frangible connections helps ensure that the removable portions of a sheet of a multi-sheet article are removed cleanly and neatly.

It is also beneficial for removable portions of a sheet to comprise magnetized material. The magnetized material can be used to removably secure the removable portions to metallic surfaces such as refrigerator doors, filing cabinets, or other suitable surfaces. This allows people to easily place the removable portions of the sheet at various desired locations for future reference.

As should be appreciated by people skilled in the art of manufacturing multi-sheet articles, the use of magnetized material in connection with the sheets of a multi-sheet article does present some difficulties and disadvantages. One such disadvantage is that, in general, the use of magnetized material results in sheets being thicker than they otherwise need be. Thus, in general, the use of magnetized material increases the overall thickness of a multi-sheet article. Another disadvantage of using magnetized material is that the magnetized material can create undesirable magnetic forces during the formation of a multi-sheet article. For example, separate portions of magnetized material on separate sheets may attract or repel each other when assembling a multi-sheet article. This can make it difficult to properly align the sheets prior to binding the sheets to each other. Additionally, magnetized material may attract or repel metallic tools utilized during the binding process and thereby impede the binding process. Yet another disadvantage associated with the use of magnetized material is that the magnetized material may not be amenable to all desired binding methods. Still further, the magnetized material may undesirably stiffen a sheet, thereby making it more difficult to turn to a particulr sheet of a multi-sheet article when such article is used.

The present invention allows the use of magnetized material in a multi-sheet article to provide the advantages discussed above, without the above-mentioned disadvantages.

SUMMARY OF THE INVENTION

In a first aspect of the invention, a multi-sheet article comprises a plurality of sheets. Each of the sheets has opposite first and second faces that share a common perimeter edge. Each sheet also has an edge margin that extends from a portion of the perimeter edge of the respective sheet. The edge margins of the sheets are bound to each other in a manner connecting the sheets to each other. At least a first one of the sheets comprises a first removable portion and at least one frangible connection that is configured and adapted to facilitate the separation of the first removable portion from the remainder of the first sheet and from the other sheets. This first removable portion comprises a portion of magnetized material. However, the edge margin of the first sheet of the multi-sheet article is devoid of magnetized material.

In another aspect of the invention, a multi-sheet article comprises a plurality of sheets. Each of the sheets has opposite front and back faces, opposite top and bottom edge margins, and opposite left and right edge margins. The left edge margins of the sheets are bound to each other in a manner connecting the sheets to each other. At least a first one of the sheets comprises a layer of non-magnetized material, a removable portion, and at least one frangible connection. The frangible connection of the first sheet is configured and adapted to facilitate the separation of the first removable portion from the remainder of the first sheet and from the other sheets. The layer of non-magnetized material has opposite front and back faces. The first sheet also comprises at least one strip of magnetized material, the strip of magnetized material has a length, a width, and a thickness that are mutually perpendicular to each other and is adhered to the back face of the layer of non-magnetized material. The frangible connection extends at least partially through the strip of magnetized material. The strip of magnetized material is spaced from the left edge margin of the first sheet.

While the principal advantages and features of the invention have been described above, a more complete and thorough understanding of the invention may be obtained by referring to the drawings and the detailed description of the preferred embodiments, which follow.

Figure 1:
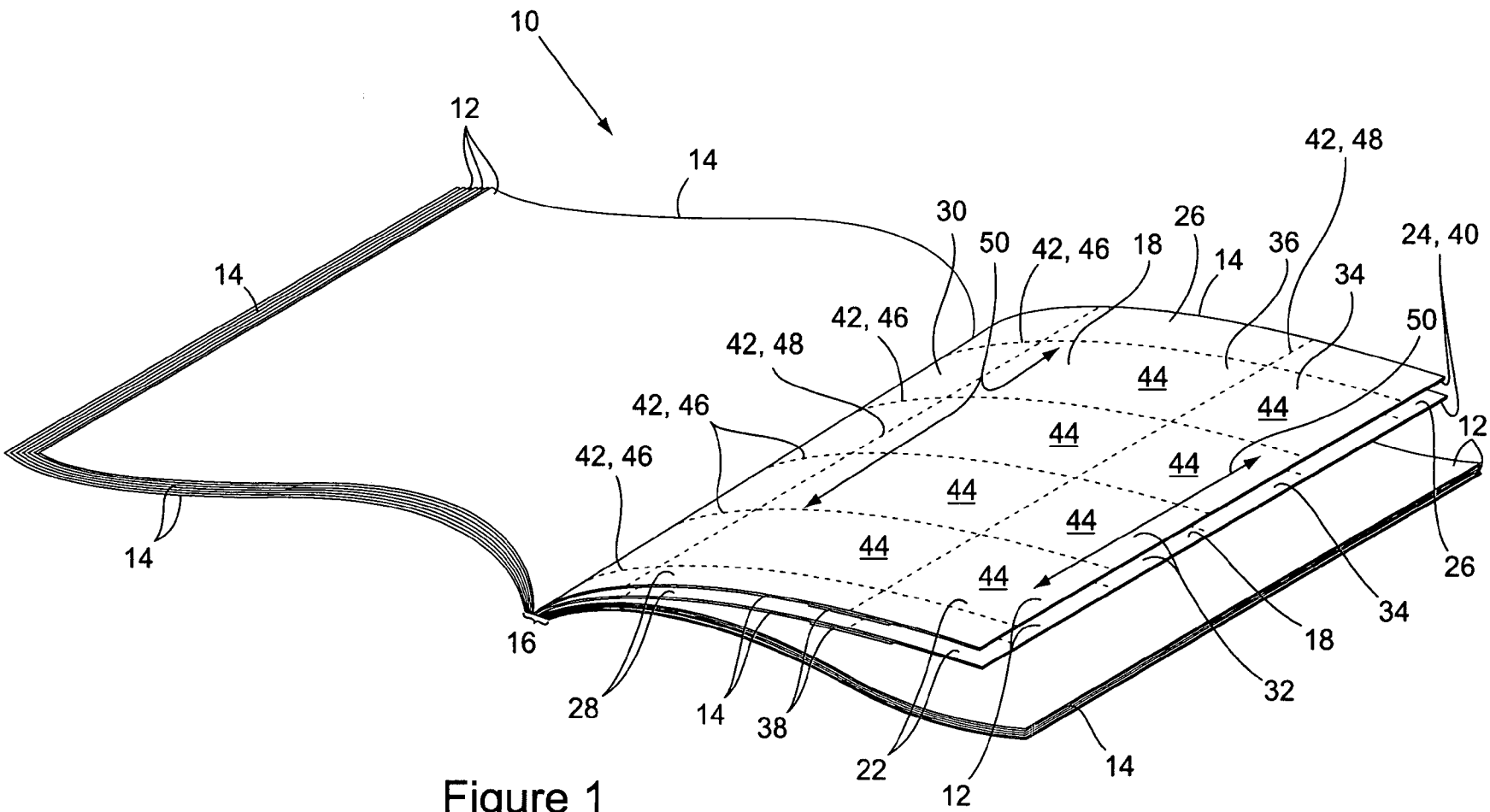
FIG. 1 is perspective view of a multi-sheet article in accordance with the invention.

Reference characters in the written specification indicate corresponding items shown throughout the drawing figures.

DETAILED DESCRIPTION OF THE PREFERRED EMBODIMENTS OF THE INVENTION

A multi-sheet article in accordance with the invention is shown in FIG. 1 and is indicated by reference numeral 10. The multi-sheet article 10 comprises a plurality of individual sheets 12. The sheets 12 preferably each have a rectangular edge perimeter 14 and are preferably similar in shape and size. The multi-sheet article 10 preferably has a binding 16 that joins and secures the sheets 12 together.

In accordance with the invention, at least one of the sheets 12 of the multi-sheet article 10 is a specialized sheet 18. A first embodiment of such a specialized sheet 18 is shown by itself in FIGS. 2 and 3, and is indicated by reference numeral 20. Like the other pages of the multi-sheet article 10, this specialized sheet 20 has opposite front 22 and back 24 faces that share an edge perimeter 14. The specialized sheet 22 also comprises opposite top 26 and bottom 28 edge margins and opposite left 30 and right 32 edge margins that extend from the edge perimeter 14.

A portion of the specialized sheet 20 is preferably formed of non-magnetized material and another portion of the specialized sheet comprises magnetized material. The portion of non-magnetized material is preferably a contiguous layer of cardstock 34 that is coterminous with the front 22 and back 24 faces of the specialized sheet 20. The front face 36 of the layer of cardstock 34 preferably forms the front face 22 of the specialized sheet 20. The portion of magnetized material is preferably at least one strip of magnetized material 38 that is adhered to the back face 40 of the layer of cardstock 34. As such, the back face 24 of the specialized sheet 20 is formed by both the strip of magnetized material 38 and the back face 40 of the layer of cardstock 34.

Figure 2:
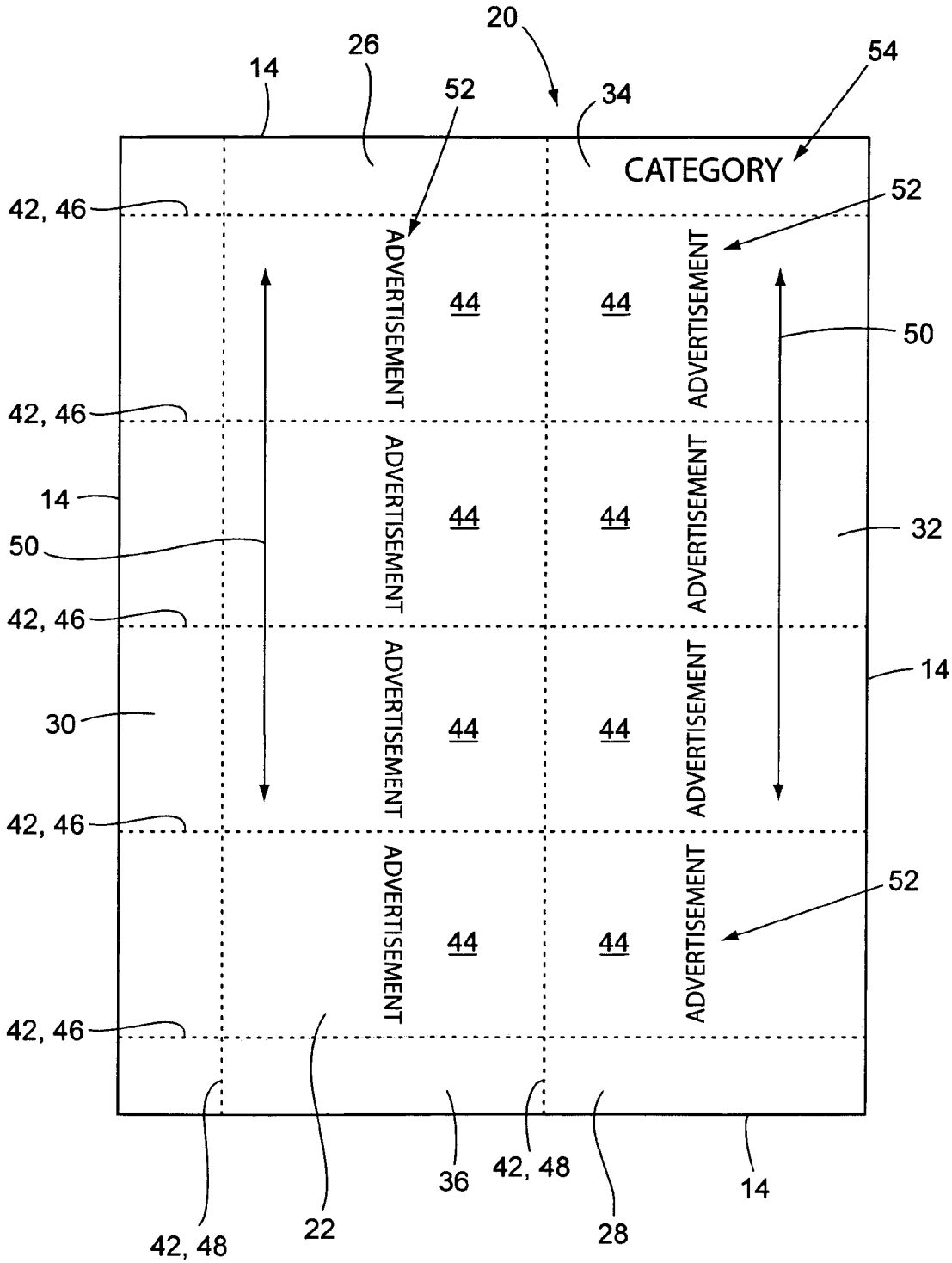
FIG. 2 is a front view of a specialized sheet of a multi-sheet article in accordance with a first embodiment of the invention.
Figure 3:
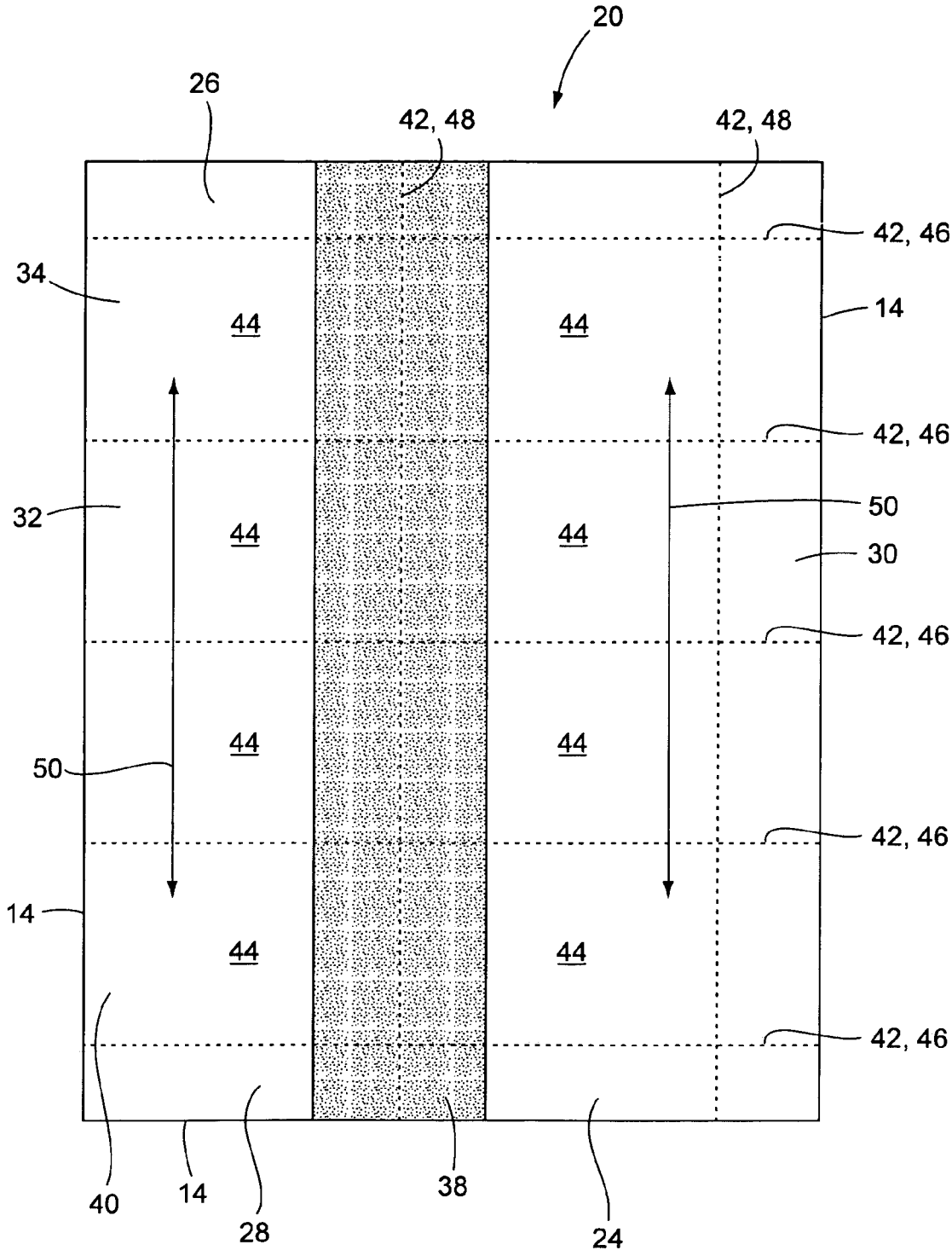
FIG. 3 is a rear view of the specialized sheet shown in FIG. 2.

The specialized sheet 20 also comprises a plurality of frangible connections 42 that are configured and adapted to facilitate the separation and removal of a plurality of removable portions 44 from the specialized sheet. Each frangible connection 42 is preferably formed by a line of perforations that extend through the thickness of the specialized sheet 20. As shown in FIGS. 2 and 3, the specialized sheet 20 preferably comprises a plurality of horizontal frangible connections 46 that are oriented parallel to the top 26 and bottom 28 edge margins of the specialized sheet 20, and a plurality of vertical frangible connections 48 that are oriented parallel to left 30 and right 32 edge margins of the specialized sheet. Each of the horizontal frangible connections 46 preferably extends from the edge perimeter 14 adjacent the left edge margin 30 to the edge perimeter adjacent the right edge margin 32. Similarly, each of the vertical frangible connections 48 preferably extends from the edge perimeter 14 adjacent the top edge margin 26 to the edge perimeter adjacent the bottom edge margin 30. Preferably, the frangible connections 42 define two columns 50 of removable portions 44 of the specialized sheet 20.

The strip of magnetized material 38 preferably overlaps the vertical frangible connection 48 that separates the two columns 50 of removable portions 44. Additionally, the strip of magnetized material 38 preferably extends from the edge perimeter 14 adjacent the top edge margin 26 to the edge perimeter adjacent the bottom edge margin 30. As such, the strip of magnetized material 38 is directly engaged with and attached to each of the removable portions 44 of the specialized sheet 20. Thus, when removed from the specialized sheet 20, each of the removable portions 44 will comprise a portion of the magnetized material 38.

Indicia 52 is preferably printed or otherwise formed on the front face 22 of the specialized sheet 20. The indicia 52 preferably takes the form of advertisements and discount coupons for various business entities. In particular, each of the removable portions 44 of the specialized sheet 20 preferably has a logo or trademark of a business printed thereon, along with contact information and some form of coupon information.

The specialized sheet 20 can be bound to a plurality of other sheets 12, some or all of which may be similar sheets having removable portions, to form the multi-sheet article 10. Preferably, the left edge margins 30 of the sheets 12 of the multi-sheet article 10 are bound to each other via conventional book binding techniques. It should be appreciated that, the left edge margin 30 of specialized sheet 20 is purposely devoid of magnetized material so that the magnetized material does not interfere with standard book binding techniques and to minimize the stiffness of the left margin of the specialized sheet. It should also be appreciated that the left edge margin 30 of the specialized sheet has a thickness equal to the thickness of the layer of cardstock 34, and that only the portion of the specialized sheet to which the strip of magnetized material 38 is adhered is thicker than the layer of cardstock. This, prevents the magnetized material from unnecessarily increasing the thickness of the multi-sheet article 10, which generally is thickest at its binding.

It is envisioned that a plurality of specialized sheets 20 in accordance with the invention will be incorporated into phone books. Preferably, the advertisements printed on the specialized sheets 20 are grouped into categories. As such, each specialized sheet 20 comprises indicia indicative of the category 54 of advertisements present on the particular specialized sheet. Preferably, this indicia indicative of the category 54 is printed on the front face 22 of the top edge margin 26, adjacent the right edge margin 32 of the specialized sheet 20.

In use, a person can locate a desired category of advertisements within the multi-sheet article 10 via the category indica 54 provided on the specialized sheets 20 and thereafter remove one or more of the removable portions 44 bearing a desired coupon or advertisement from a particular specialized sheet 20. The frangible connections 42 of the specialized sheet 20 allow the person to remove the removable portions 44 of the specialized sheet by hand and without using any tool. When separated from the specialized sheet 20 and the multi-sheet article 10, each removable portion 44 comprises a portion of the strip of magnetized material 38. The magnetized material on each of the removable portions 44 allows the removable portions to be removably attached to metallic items, such as a refrigerator, where they can be referenced conveniently in the future.

Figure 4:
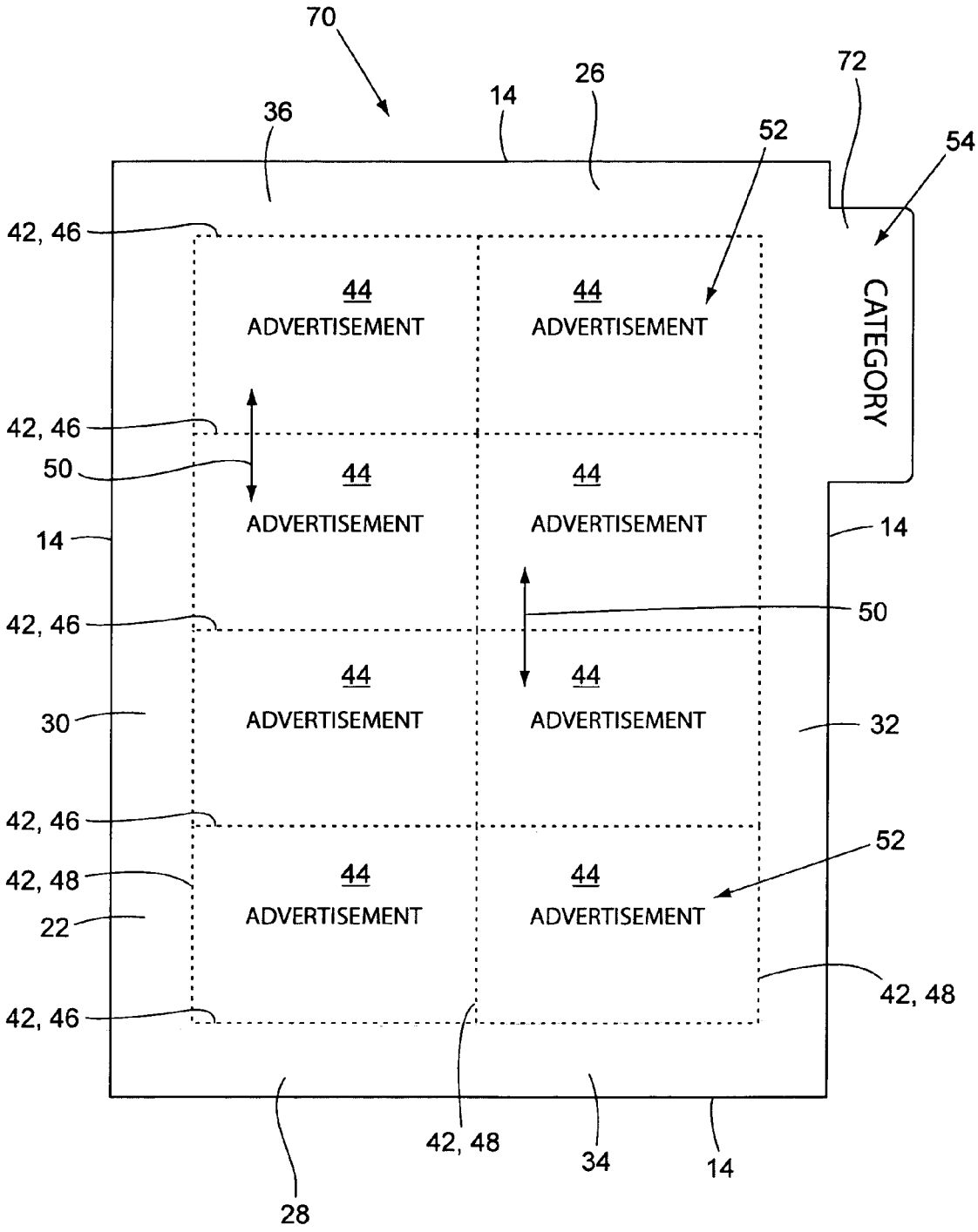
FIG. 4 is a front view of a specialized sheet of a multi-sheet article in accordance with a second embodiment of the invention.
Figure 5:
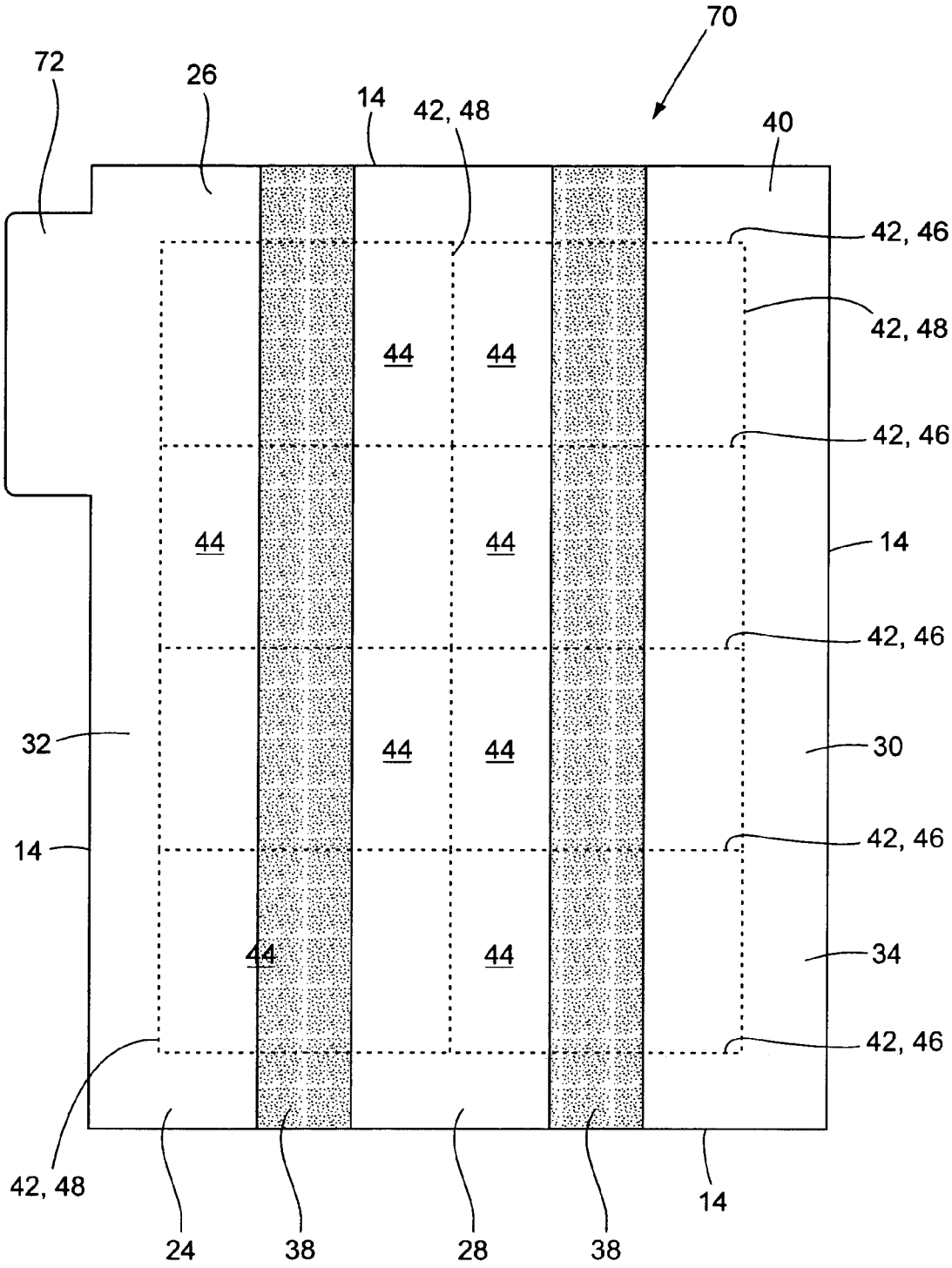
FIG. 5 is a rear view of the specialized sheet shown in FIG. 4.

A second embodiment of a specialized sheet for use in connection with a multi-sheet article in accordance with the invention is shown in FIGS. 4 and 5. Like the specialized sheet 20 of the first embodiment, this specialized sheet 70 comprises opposite front 22 and back 24 faces that have a common an edge perimeter 14, opposite top 26 and bottom 28 edge margins, opposite left 30 and right 32 edge margins, a layer of cardstock 34, a strip of magnetized material 38, and a plurality of frangible connections 42 that define a plurality of removable portions 44. However, this specialized sheet 70 has a different configuration of frangible connections 42 and other differences.

In particular, although the specialized sheet 70 of the second embodiment has a plurality of linear frangible connections 42 that are oriented in substantially the same pattern as those of the specialized sheet 20 of the first embodiment, the second embodiment comprises an additional vertically oriented frangible connection 48. Additionally, each of the frangible connections 42 terminates short of the edge perimeter 14. As such, the entire edge perimeter 14 of this embodiment remains intact after the removal of any of the removable portions 44 from the sheet 70.

The specialized sheet 70 of the second embodiment also preferably comprises two vertically oriented strips of magnetized material 38. Like the strip of magnetized material 38 of the first embodiment, each of the strips of magnetized material of the second embodiment preferably extend from the edge perimeter 14 at the top edge margin 26 to the edge perimeter at the bottom edge margin 28. Each of the strips of magnetized material 38 preferably bisects one of the columns of the removable portions 44 of the specialized sheet 70. Thus, unlike the removable portions 44 of the specialized sheet 20 of the first embodiment, each of the removable portions 44 of the specialized sheet 70 of the second embodiment has a portion of magnetized material centered thereon.

The specialized sheet 70 of the second embodiment also preferably comprises a tab 72 that is formed by the layer of cardstock 34 and that protrudes outwardly from the remainder of the right edge margin 32 of the specialized sheet. The tab preferably comprises indicia indicative of the category 54 of advertisement depicted on the removable portions 44 of the specialized sheet 70.

When assembled as part of a multi-sheet article 10, the specialized sheet 70 of the second embodiment can be utilized in substantially the same manner as the specialized sheet 20 of the first embodiment and provides similar advantages. Additionally, the tab 72 of the specialized sheet 70 provides a means for quickly selecting the specialized sheet from among the other sheets 12 of the multi-sheet article 10 based upon the category indicia 54 displayed on the tabs. Furthermore, because the entire edge perimeter 14 of the specialized sheet 70 remains intact regardless of the removal of the removable portions 44, the overall thickness of the multi-sheet article 10 remains generally constant as removable portions are removed from the specialized sheets. As should be appreciated, this is both aesthetically and functionally beneficial. Additionally, this aspect of the specialized sheet 70 of the second embodiment ensures that the tab 72 remains attached to the specialized sheet, regardless of which of the removable portions 44 have been detached from the specialized sheet.

While the present invention has been described in reference to specific embodiments, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. For example, select features of each of the embodiments of specialized sheets disclosed herein could be combined to create alternative embodiments. Thus, other possible variations and modifications should be appreciated.

Furthermore, it should be understood that when introducing elements of the present invention in the claims or in the above description of the preferred embodiment of the invention, the terms "comprising," "including," "wherein," and "having" are intended to be open-ended and mean that there may be additional elements other than the listed elements. Additionally, terms such as "first" and "second" should be construed as merely identifiers for referring back to a particular recited element rather than imposing any spatial, time, or other limitation to the element that it qualifies.

What is claimed is:

1. A multi-sheet article comprising:

a plurality of sheets, each of the sheets having opposite first and second faces that share a common perimeter edge, each sheet having an edge margin that extends from a portion of the perimeter edge of the respective sheet, the edge margins of the sheets being bound to each other in a manner connecting the sheets to each other, at least a first one of the sheets comprising a first removable portion and at least one frangible connection that is configured and adapted to facilitate the separation of the first removable portion from the remainder of the first sheet and from the other sheets, the first removable portion comprising a portion of magnetized material, the edge margin of the first sheet being devoid of magnetized material.

2. A multi-sheet article in accordance with claim 1 wherein the first removable portion of first sheet has a maximum thickness between the first and second faces of the first sheet, the edge margin of the first sheet has a maximum thickness between the first and second faces of the first sheet, and the maximum thickness of the first removable portion is greater than the maximum thickness of the edge margin of the first sheet.

3. A multi-sheet article in accordance with claim 1 wherein the portion of magnetized material defines a portion of one of the first and second faces of the first sheet.

4. A multi-sheet article in accordance with claim 1 wherein the first sheet comprises a contiguous layer of non-magnetized material that is coterminous with the perimeter edge of the first sheet, the layer of non-magnetized material having opposite first and second faces, the first face of the layer of non-magnetized material constituting the first face of the first sheet, the portion of magnetized material being a strip of magnetized material having a width and a thickness, the thickness of the strip of magnetized material being less than the width of the strip of magnetized material and defining opposite first and second faces of the strip of magnetized material, the first face of the strip of magnetized material being engaged with the second face of the layer of non-magnetized material, the second face of the strip of magnetized material and at least one portion of the second face of the layer of non-magnetized material forming the second face of the first sheet.

5. A multi-sheet article in accordance with claim 4 wherein the first sheet comprises a plurality of removable portions, the at least one frangible connection being configured and adapted to facilitate the separation of the plurality of removable portions from the remainder of the first sheet, from the other sheets, and from each other, each of the plurality of removable portions comprising a portion of the strip of magnetized material.

6. A multi-sheet article in accordance with claim 5 wherein the plurality of removable portions constitute the only removable portions of the first sheet.

7. A multi-sheet article in accordance with claim 4 wherein the at least one frangible connection comprises a line of perforations, the perforations extend through the first sheet from the first face of the first sheet to the second face of the first sheet, and at least some of the perforations extend through both the layer of non-magnetized material and the strip of magnetized material.

8. A multi-sheet article in accordance with claim 4 wherein the strip of magnetized material has a length that is perpendicular to the width of the strip of magnetized material and to the thickness of the strip of magnetized material, the length of the strip of magnetized material terminating at first and second portions of the perimeter edge of the first sheet.

9. A multi-sheet article in accordance with claim 8 wherein the first sheet comprises a plurality of frangible connections, each of the frangible connections comprises a line of perforations, each of the perforations extends through the first sheet from the first face of the first sheet to the second face of the first sheet, at least one of the lines of perforations extends parallel to the length of the magnetized strip and through both the layer of non-magnetized material and the strip of magnetized material, and at least a portion of another one of the lines of perforations extends parallel to the width of the strip of magnetized material and through both the layer of non-magnetized material and the strip of magnetized material.

10. A multi-sheet article in accordance with claim 1 wherein the first sheet is devoid of any frangible connection that extends to the perimeter edge of the first sheet.

11. A multi-sheet article comprising:

a plurality of sheets, each of the sheets having opposite front and back faces, opposite top and bottom edge margins, and opposite left and right edge margins, the left edge margins of the sheets being bound to each other in a manner connecting the sheets to each other, at least a first one of the sheets comprising a layer of non-magnetized material, a removable portion, and at least one frangible connection, the frangible connection being configured and adapted to facilitate the separation of the first removable portion from the remainder of the first sheet and from the other sheets, the layer of non-magnetized material having opposite front and back faces, the first sheet also comprising at least one strip of magnetized material, the strip the magnetized material having a length, a width, and a thickness that are mutually perpendicular to each other, the strip of magnetized material being adhered to the back face of the layer of non-magnetized material, the frangible connection extending at least partially through the strip of magnetized material, the strip of magnetized material being spaced from the left edge margin of the first sheet.

12. A multi-sheet article in accordance with claim 11 wherein the frangible connection forms a line that extends parallel to the length of the strip of magnetized material.

13. A multi-sheet article in accordance with claim 11 wherein the frangible connection forms a line that extends perpendicular to the length of the strip of magnetized material.

14. A multi-sheet article in accordance with claim 11 wherein the first sheet comprises a plurality of frangible connections that are configured and adapted to facilitate the separation of the first removable portion from the remainder of the first sheet and from the other sheets, at least a first one of the frangible connections defining a line that extends parallel to left edge margin of the first sheet and at least a second one of the frangible connections defining a line that extends parallel to top edge margin of the first sheet.

15. A multi-sheet article in accordance with claim 14 wherein the first and second frangible connections each extend at least partially through the strip of magnetized material.

16. A multi-sheet article in accordance with claim 11 wherein the first sheet further comprises top and bottom edges, the top edge margin of the first sheet terminating at the top edge of the first sheet, the bottom edge margin of the first sheet terminating at the bottom edge of the first sheet, the length of the strip of magnetized material extending from the top edge of the first sheet and to the bottom edge of the first sheet.

17. A multi-sheet article in accordance with claim 11 wherein the first sheet comprises a perimeter edge defined by the top, bottom, left, and right edge margins, the first sheet being devoid of any frangible connection that extends to the perimeter edge of the first sheet.

18. A multi-sheet article in accordance with claim 11 wherein the first sheet comprises a plurality of removable portions and a plurality of frangible connections, the plurality of frangible connections being configured and adapted to facilitate the separation of each of the removable portions from the remainder of the first sheet, from the other sheets, and from each other, the strip of magnetized material being engaged with each of the plurality of removable portions.

19. A multi-sheet article in accordance with claim 18 wherein the plurality of removable portions constitute the only removable portions of the first sheet.

20. A multi-sheet article in accordance with claim 11 wherein the frangible connection comprises a line of perforations, each of the perforations extending through the first sheet from the front face of the first sheet to the back face of the first sheet.

* * * * *